US009945130B2

(12) United States Patent
Nygren et al.

(10) Patent No.: US 9,945,130 B2
(45) **Date of Patent: *Apr. 17, 2018**

(54) BUILDING PANELS PROVIDED WITH A MECHANICAL LOCKING SYSTEM

(71) Applicant: Välinge Innovation AB, Viken (SE)

(72) Inventors: Per Nygren, Ramlösa (SE); Marcus Bergelin, Lerberget (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/333,449

(22) Filed: Oct. 25, 2016

(65) Prior Publication Data

US 2017/0037641 A1 Feb. 9, 2017

Related U.S. Application Data

(63) Continuation of application No. 14/881,614, filed on Oct. 13, 2015, now Pat. No. 9,482,012, which is a (Continued)

(51) Int. Cl.
*E04F 15/02* (2006.01)
*E04F 15/10* (2006.01)

(52) U.S. Cl.
CPC ..... *E04F 15/02038* (2013.01); *E04F 15/102* (2013.01); *E04F 15/107* (2013.01); (Continued)

(58) Field of Classification Search
CPC ..... E04F 13/0894; E04F 15/02038; E04F 2201/0547; E04F 2201/0541; E04F 2201/0523; E04F 2201/0511
See application file for complete search history.

(56) References Cited

U.S. PATENT DOCUMENTS 261,030 A 7/1882 Orcutt
301,775 A 7/1884 Thompson
(Continued)

FOREIGN PATENT DOCUMENTS

CA 2456513 A1 2/2003
DE 299 22 649 U1 4/2000
(Continued)

OTHER PUBLICATIONS

Extended European Search Report dated Sep. 26, 2016 in EP 14760606.5, European Patent Office, Munich, DE, 8 pages.
(Continued)

*Primary Examiner* — Christine T Cajilig
(74) *Attorney, Agent, or Firm* — Buchanan Ingersoll & Rooney P.C.

(57) ABSTRACT

Building panels, such as floorboards, provided with a mechanical locking system. The mechanical locking system includes a displacement groove at a first edge of a first floorboard and a tongue groove at a second edge of a second floorboard. A tongue is arranged in the displacement groove and is configured to cooperate, in a second position, with the tongue groove for vertical locking of the first and the second edge. The tongue includes, in a first position, an inner element and an outer element. The inner element is removable along the displacement groove, and is configured to cooperate with the outer element to obtain a displacement of the outer element towards the tongue groove and thereby obtain the second position. The inner element and the outer element vertically overlap each other.

26 Claims, 5 Drawing Sheets

Related U.S. Application Data continuation of application No. 14/200,909, filed on Mar. 7, 2014, now Pat. No. 9,194,134.

(60) Provisional application No. 61/774,749, filed on Mar. 8, 2013.

(52) U.S. Cl.
CPC ..... *E04F 2201/0153* (2013.01); *E04F 2201/0511* (2013.01); *E04F 2201/0547* (2013.01); *E04F 2201/0588* (2013.01)

(56) References Cited

U.S. PATENT DOCUMENTS 526,044 A 9/1894 Merrill
917,352 A 4/1909 Palmer
1,352,620 A 9/1920 Onsrud
1,911,598 A 5/1933 Ashmun
2,005,647 A 6/1935 Crouch
2,054,828 A 9/1936 Melde
2,571,861 A 10/1951 Gegumis
2,791,247 A 5/1957 Gerson
2,863,185 A 12/1958 Riedi
2,876,812 A 3/1959 Waldron
3,082,802 A 3/1963 Dickson et al.
3,774,660 A 11/1973 Morey et al.
3,778,954 A 12/1973 Meserole
3,817,305 A 6/1974 Gibbs
3,913,642 A 10/1975 Porter
3,986,543 A 10/1976 Slayton et al.
4,082,129 A 4/1978 Morelock
4,151,869 A 5/1979 Halloran et al.
5,026,112 A 6/1991 Rice
5,182,892 A 2/1993 Chase
5,348,778 A 9/1994 Knipp et al.
5,694,730 A 12/1997 Del Rincon et al.
6,164,349 A 12/2000 Hsieh
6,164,351 A 12/2000 Weathers
6,345,481 B1 2/2002 Nelson
6,363,677 B1 4/2002 Chen et al.
6,385,936 B1 5/2002 Schneider
6,386,250 B1 5/2002 Liu
6,450,235 B1 9/2002 Lee
6,591,568 B1 7/2003 Pålsson
6,617,009 B1 9/2003 Chen et al.
6,647,689 B2 11/2003 Pletzer et al.
6,647,690 B1 11/2003 Martensson
6,685,391 B1 2/2004 Gideon
6,766,622 B1 7/2004 Thiers
6,804,926 B1 10/2004 Eisermann
6,862,857 B2 3/2005 Tychsen
6,874,291 B1 4/2005 Weber
6,880,307 B2 4/2005 Schwitte et al.
7,051,486 B2 5/2006 Pervan
7,152,383 B1 12/2006 Wilkinson et al.
7,337,588 B1 3/2008 Moebus
7,451,578 B2 11/2008 Hannig
7,454,875 B2 11/2008 Pervan et al.
7,516,588 B2 4/2009 Pervan
7,533,500 B2 5/2009 Morton et al.
7,584,583 B2 9/2009 Bergelin et al.
7,621,092 B2 11/2009 Groeke et al.
7,634,884 B2 12/2009 Pervan
7,637,068 B2 12/2009 Pervan
7,644,742 B2 1/2010 Burkholder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,930,862 B2 4/2011 Bergelin et al.
7,954,523 B2 6/2011 Liu
7,980,039 B2 7/2011 Groeke
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 8/2012 Pervan et al.
8,281,549 B2 10/2012 Du
8,302,367 B2 11/2012 Schulte
8,336,272 B2 12/2012 Prager
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,516,767 B2 8/2013 Engstrom
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Pervan
9,091,077 B2 7/2015 Boo
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan
9,458,634 B2 10/2016 Derelov
9,482,012 B2 11/2016 Nygren et al.
9,540,826 B2 1/2017 Pervan et al.
9,663,940 B2 5/2017 Boo

(56) References Cited

U.S. PATENT DOCUMENTS

2002/0069611 A1 6/2002 Leopolder
2002/0092263 A1 7/2002 Schulte
2002/0095894 A1 7/2002 Pervan
2002/0170259 A1 11/2002 Ferris
2002/0178674 A1 12/2002 Pervan
2003/0009971 A1 1/2003 Palmberg
2003/0009972 A1 1/2003 Pervan
2003/0024199 A1 2/2003 Pervan et al.
2003/0037504 A1 2/2003 Schwitte et al.
2003/0084636 A1 5/2003 Pervan
2003/0101681 A1 6/2003 Tychsen
2004/0016196 A1 1/2004 Pervan
2004/0049999 A1 3/2004 Krieger
2004/0060255 A1 4/2004 Knauseder
2004/0128934 A1 7/2004 Hecht
2004/0139678 A1 7/2004 Pervan
2004/0177584 A1 9/2004 Pervan
2004/0182036 A1 9/2004 Sjoberg et al.
2004/0211143 A1 10/2004 Hannig
2004/0250492 A1 12/2004 Becker
2005/0050827 A1 3/2005 Schitter
2005/0160694 A1 7/2005 Pervan
2005/0166514 A1 8/2005 Pervan
2005/0210810 A1 9/2005 Pervan
2006/0070333 A1 4/2006 Pervan
2006/0101769 A1 5/2006 Pervan
2006/0174577 A1 8/2006 O'Neil
2006/0174578 A1 8/2006 Konstanczak
2006/0236642 A1 10/2006 Pervan
2006/0260254 A1 11/2006 Pervan et al.
2007/0006543 A1 1/2007 Engström
2007/0011981 A1 1/2007 Eiserman
2007/0028547 A1 2/2007 Grafenauer
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0017274 A1 1/2008 Burkholder
2008/0028707 A1 2/2008 Pervan
2008/0028713 A1 2/2008 Pervan
2008/0034708 A1 2/2008 Pervan
2008/0041007 A1 2/2008 Pervan et al.
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1* 6/2008 Pervan ..... E04F 15/02038 52/395
2008/0134613 A1* 6/2008 Pervan ..... E04F 15/02 52/582.2
2008/0134614 A1 6/2008 Pervan
2008/0155930 A1 7/2008 Pervan et al.
2008/0209838 A1 9/2008 Pervan
2008/0216434 A1 9/2008 Pervan
2008/0216920 A1 9/2008 Pervan
2008/0241440 A1 10/2008 Bauer
2008/0295432 A1 12/2008 Pervan et al.
2009/0019806 A1 1/2009 Muehlebach
2009/0133353 A1 5/2009 Pervan et al.
2009/0193741 A1 8/2009 Cappelle
2009/0193748 A1* 8/2009 Boo ..... B27F 1/02 52/589.1
2010/0043921 A1 2/2010 Liu
2010/0135740 A1 6/2010 Harif
2010/0293879 A1 11/2010 Pervan et al.
2010/0300029 A1 12/2010 Braun et al.
2010/0300031 A1 12/2010 Pervan et al.
2010/0319290 A1 12/2010 Pervan
2010/0319291 A1 12/2010 Pervan et al.
2011/0030303 A1* 2/2011 Pervan ..... B27F 1/08 52/582.1
2011/0041996 A1 2/2011 Pervan
2011/0088344 A1 4/2011 Pervan et al.
2011/0088345 A1 4/2011 Pervan
2011/0131916 A1 6/2011 Chen
2011/0154763 A1 6/2011 Bergelin et al.
2011/0167750 A1 7/2011 Pervan
2011/0197535 A1 8/2011 Baker et al.
2011/0225922 A1 9/2011 Pervan et al.
2011/0252733 A1 10/2011 Pervan
2011/0283650 A1 11/2011 Pervan et al.
2012/0017533 A1* 1/2012 Pervan ..... E04F 15/02 52/588.1
2012/0031029 A1 2/2012 Pervan et al.
2012/0036804 A1 2/2012 Pervan
2012/0151865 A1 6/2012 Pervan et al.
2012/0174515 A1 7/2012 Pervan
2012/0174520 A1 7/2012 Pervan
2012/0192521 A1 8/2012 Schulte
2012/0279161 A1 11/2012 Håkansson et al.
2012/0317911 A1 12/2012 Huang
2013/0008117 A1 1/2013 Pervan
2013/0014463 A1 1/2013 Pervan
2013/0019555 A1 1/2013 Pervan
2013/0036695 A1 2/2013 Dürnberger
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.
2013/0263454 A1 10/2013 Boo et al.
2013/0263547 A1 10/2013 Boo
2013/0318906 A1 12/2013 Pervan et al.
2014/0007539 A1 1/2014 Pervan et al.
2014/0020324 A1 1/2014 Pervan
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0150369 A1 6/2014 Hannig
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0366476 A1 12/2014 Pervan
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.

(56) References Cited

U.S. PATENT DOCUMENTS

| | | | |
|---|---|---|---|
| 2016/0153200 | A1 | 6/2016 | Pervan |
| 2016/0168866 | A1 | 6/2016 | Pervan et al. |
| 2016/0186426 | A1 | 6/2016 | Boo |
| 2016/0194884 | A1 | 7/2016 | Pervan et al. |
| 2016/0201336 | A1 | 7/2016 | Pervan |
| 2016/0251859 | A1 | 9/2016 | Pervan et al. |
| 2016/0251860 | A1 | 9/2016 | Pervan |
| 2016/0281368 | A1 | 9/2016 | Pervan et al. |
| 2016/0281370 | A1 | 9/2016 | Pervan et al. |
| 2016/0326751 | A1 | 11/2016 | Pervan |
| 2016/0340913 | A1 | 11/2016 | Derelöv |
| 2017/0081860 | A1 | 3/2017 | Boo |

FOREIGN PATENT DOCUMENTS

| | | | | |
|---|---|---|---|---|
| DE | 200 01 788 | U1 | 6/2000 | |
| DE | 10 2004 055 951 | A1 | 7/2005 | |
| DE | 10 2006 024 184 | A1 | 11/2007 | |
| DE | 10 2006 037 614 | B3 | 12/2007 | |
| DE | 10 2007 018 309 | A1 | 8/2008 | |
| DE | 10 2007 016 533 | A1 | 10/2008 | |
| DE | 10 2007 032 885 | A1 | 1/2009 | |
| DE | 102007032885 | A1 * | 1/2009 | ..... E04F 15/02 |
| DE | 10 2011 052 335 | A1 | 2/2013 | |
| DE | 102011052335 | A1 * | 2/2013 | ..... E04F 15/02038 |
| DE | 10 2007 018 309 | B4 | 7/2013 | |
| EP | 0 974 713 | A1 | 1/2000 | |
| EP | 1 420 125 | A2 | 5/2004 | |
| EP | 1 650 375 | A1 | 4/2006 | |
| EP | 1 650 375 | A8 | 9/2006 | |
| EP | 2 573 295 | A1 | 3/2013 | |
| FR | 1.138.595 | | 6/1957 | |
| FR | 2 256 807 | | 8/1975 | |
| FR | 2 875 718 | A1 | 11/2012 | |
| FR | 2 975 716 | A1 | 11/2012 | |
| FR | 2 975 717 | A1 | 11/2012 | |
| FR | 2975716 | A1 * | 11/2012 | ..... E04F 13/0894 |
| FR | 2975718 | A1 * | 11/2012 | ..... E04F 13/0894 |
| SE | 529 076 | C2 | 4/2007 | |
| WO | WO 94/26999 | A1 | 11/1994 | |
| WO | WO 97/47834 | A1 | 12/1997 | |
| WO | WO 01/02671 | A1 | 1/2001 | |
| WO | WO 01/02672 | A1 | 1/2001 | |
| WO | WO 01/38657 | A1 | 5/2001 | |
| WO | WO 01/48332 | A1 | 7/2001 | |
| WO | WO 01/51732 | A1 | 7/2001 | |
| WO | WO 01/75247 | A1 | 10/2001 | |
| WO | WO 03/016654 | A1 | 2/2003 | |
| WO | WO 03/038210 | A1 | 5/2003 | |
| WO | WO 03/069094 | A1 | 8/2003 | |
| WO | WO 03/083234 | A1 | 10/2003 | |
| WO | WO 2004/048716 | A1 | 6/2004 | |
| WO | WO 2004/079130 | A1 | 9/2004 | |
| WO | WO 2004/085765 | A1 | 10/2004 | |
| WO | WO 2006/043893 | A1 | 4/2006 | |
| WO | WO 2006/104436 | A1 | 10/2006 | |
| WO | WO 2007/015669 | A2 | 2/2007 | |
| WO | WO 2007/020088 | A1 | 2/2007 | |
| WO | WO 2007/089186 | A1 | 8/2007 | |
| WO | WO 2007/118352 | A1 | 10/2007 | |
| WO | WO 2008/004960 | A2 | 1/2008 | |
| WO | WO 2008/004960 | A8 | 1/2008 | |
| WO | WO 2008/017281 | A1 | 2/2008 | |
| WO | WO 2008/017301 | A2 | 2/2008 | |
| WO | WO 2008/017301 | A3 | 2/2008 | |
| WO | WO 2008/116623 | A1 | 10/2008 | |
| WO | WO 2008/122479 | A1 | 10/2008 | |
| WO | WO 2009/116926 | A1 | 9/2009 | |
| WO | WO 2010/006684 | A1 | 1/2010 | |
| WO | WO 2010/087752 | A1 | 8/2010 | |
| WO | WO 2010/108980 | A1 | 9/2010 | |
| WO | WO 2010108980 | A1 * | 9/2010 | ..... E04F 15/02038 |
| WO | WO 2010/142671 | A1 | 12/2010 | |
| WO | WO 2011/038709 | A1 | 4/2011 | |
| WO | WO 2011/075933 | A1 | 6/2011 | |
| WO | WO 2011/127981 | A1 | 10/2011 | |
| WO | WO 2011127981 | A1 * | 10/2011 | ..... E04F 15/02038 |
| WO | WO 2011/153916 | A1 | 12/2011 | |
| WO | WO 2013/025163 | A1 | 2/2013 | |

OTHER PUBLICATIONS

U.S. Appl. No. 15/379,855, Pervan, et al.

International Search Report dated May 28, 2014 in PCT/SE2014/050285, Patent-och Registreringsverket, Stockholm, SE, 4 pages.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.

Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.

Pervan, Darko, et al., U.S. Appl. No. 15/379,855 entitled "Mechanical Lockings of Floor Panels and a Tongue Blank," filed Dec. 15, 2016.

* cited by examiner

KNOWN TECHNOLOGY

BUILDING PANELS PROVIDED WITH A MECHANICAL LOCKING SYSTEM

CROSS REFERENCE TO RELATED APPLICATIONS

This application is a continuation of U.S. application Ser. No. 14/881,614, filed on Oct. 13, 2015, which is a continuation of U.S. application Ser. No. 14/200,909, filed on Mar. 7, 2014, now U.S. Pat. No. 9,194,134, which claims the benefit of Provisional Application No. 61/774,749 filed on Mar. 8, 2013. The disclosure of each of U.S. application Ser. No. 14/881,614, U.S. application Ser. No. 14/200,909 and Provisional Application No. 61/774,749 is hereby incorporated by reference herein in its entirety.

TECHNICAL FIELD

The present disclosure relates to a building panel such as a floor panel, a wall panel, a ceiling panel, a furniture component or the like, which is provided with a mechanical locking system comprising a displaceable tongue.

TECHNICAL BACKGROUND

Building panels provided with a mechanical locking system comprising a displaceable tongue cooperating with a tongue groove for vertical locking is known and disclosed in, e.g., FR 2 975 717. The mechanical locking system in FR 2 975 717 has a displaceable tongue comprising an outer element which is pushed by a wedge part of a removable inner part of the tongue into a tongue groove, for vertical locking of adjacent edges of two floorboards. A drawback with this known system is that the locking strength is rather low.

The above description of various known aspects and drawback is the Applicant's characterization of such, and is not an admission that any of the above description is considered as prior art.

Although the description in the present disclosure relates to a floor panel, the description of techniques and problems thereof is applicable to other applications as well. For example, the description is also applicable to panels for other purposes, such as wall panels, ceiling panels, furniture panels and components, etc.

SUMMARY

It is an object of embodiments of the present disclosure to provide an improvement over the above described conventional techniques.

A further object of embodiments of the present disclosure is to provide building panels, such as floorboards, provided with a locking system that comprises a tongue that improves the vertical locking of the floorboards.

Another object of embodiments of the present disclosure is to provide a more efficient production method, which requires less complicated production equipment.

At least some of these and other objects and advantages that will be apparent from the present disclosure have been achieved by certain embodiments of the building panels described herein. The building panels, such as floorboards, are provided with a locking system that comprises a displacement groove at a first edge of a first floorboard and a tongue groove at a second edge of a second floorboard. A tongue is arranged in the displacement groove and is configured to cooperate, in a second position, with the tongue groove for vertical locking of the first edge and the second edge. The tongue comprises, in a first position, an inner element and an outer element. the inner element is removable along the displacement groove, and is configured to cooperate with the outer element to obtain a displacement of the outer element towards the tongue groove and thereby obtain the second position. The inner element and the outer element are preferably configured to vertically overlap each other in the first position to obtain an increased contact surface between a surface of the displacement groove and the outer element of the tongue in the second position. The inner element and the outer element are arranged such that the increased contact surface takes up a moment of force that arises on the tongue when a load is applied on the first or the second floorboard. The inner element in the first position may be arranged above or below the outer element. The inner element in the first position may also be arranged partly above partly behind the outer element, or may be arranged partly below the outer element and partly behind the outer element.

The entire outer element is in the first position preferably arranged within the displacement groove.

The outer element maybe provided with a guiding groove at either an inner and upper edge of the outer element or at an inner and lower edge of the outer element, wherein at least a part of the inner element in the first position is arranged in said guiding groove. The outer element may be provided with a guiding groove at an inner surface of the outer element, between an upper surface and lower surface of the outer element, wherein at least a part of the inner element is arranged in said guiding groove in the first position. The guiding groove facilitates the removal of the inner element by guiding the inner element in a controlled manner and provides a groove without obstructions and desired friction. The guiding groove preferably extends essentially along the whole longitudinal length of the outer element. This embodiment of the outer element provides for a simple production of the outer element for example by plastic profile extrusion and cutting of the profile in the desired length.

The inner element preferably comprises a first protruding part configured to cooperate with the guiding groove, to obtain said displacement of the outer element.

The first protruding part in the first position is preferably arranged outside of the outer element and/or in a recess of the outer element. When the inner element is removed by a displacement along the displacement groove and preferably in the guiding groove, the outer element is gradually pushed into the tongue groove to obtain the second position.

The first protruding part may be wedge shaped or of an essentially spherical shape. Such shapes facilitate the displacement of the inner element. The outer element may also be provided with guiding surfaces at the location of the first protruding part in the first position. The first protruding part is preferably elastic, to make it easier to displace the first protruding part over irregularities in the displacement groove. The first protruding part may comprise an elastic material and may be provided with a recess to increase the elasticity.

The inner element is preferably provided with a second protruding part, preferably configured such that the second protruding part is easy to grasp by an installer of the floorboards. The second protruding part may also be configured such that the inner element is secured in the correct position.

The cross section of the inner element may be L-shaped or rectangular or of an essentially circular shape.

The inner element may comprise plastic and may be produced by injection molding or extrusion. An extruded inner element of plastic may be provided with the first and or the second protruding part by heating and compressing a part of the extruded profile in a press tool.

The inner and outer element may be produced in one piece by injection molding of plastic and connected together by a connection configured to break when the inner element is displaced or when the tongue is inserted into the displacement groove.

The building panels may comprise a wood-based core, preferably made of at least one of MDF, HDF, OSB, WPC (Wood Powder Composite), and particleboard, or of plastic, such as vinyl or PVC.

BRIEF DESCRIPTION OF THE DRAWINGS

The present disclosure will by way of example be described in more detail with reference to the appended schematic drawings, which illustrate several embodiments.

DETAILED DESCRIPTION

Figure 1:
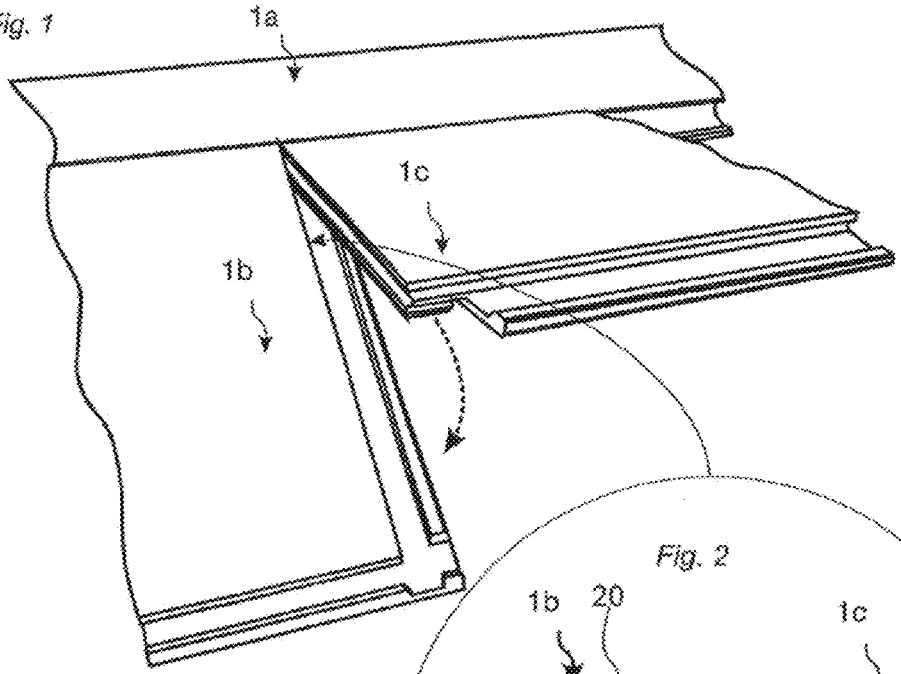
FIGS. 1-3 show a known locking system with a tongue comprising an inner and an outer element.
Figure 2:
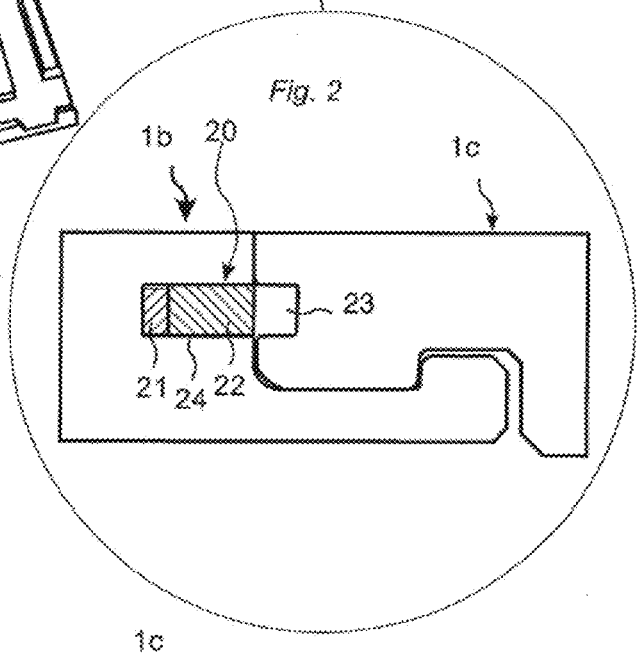
Figure 3:
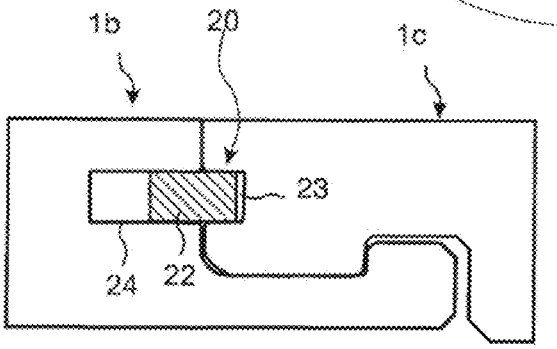

FIGS. 1-3 show floorboards provided with a known locking system which comprises a tongue 20 having an inner element 21 and an outer element 22. The tongue 20 is arranged in a displacement groove 24 at a first edge 1*b* of a first floorboard. FIG. 1 shows a position during assembling of the first floorboard. The first floorboard is arranged in a second row and is connected at a third edge to a fourth edge of a third floorboard in first row. A second floorboard is arranged in an angled position with a third edge adjacent the fourth edge of the third floorboard and a second edge 1*c* of the second floorboard is arranged adjacent the first edge 1*b* of the first floorboard.

FIG. 2 shows a cross-section of the first edge 1*b* and the second edge 1*c* after the second floorboard is angled down and connected to the third floorboard in the first row. The first edge 1*b* and the second edge 1*c* are in FIG. 2 locked together in the horizontal direction, and the inner element 21 and the outer element 22 of the tongue 20 are arranged in a first position. The first edge 1*b* and the second edge 1*c* are in the first position vertically un-locked. To lock the first edge 1*b* and the second edge 1*c* in the vertical direction, the inner element 21 is displaced and removed along the first edge 1*b*. The inner element 21 is provided with a protruding part. The protruding part pushes the outer element 22 of the tongue 20 into a tongue groove 23 at the second edge 1*c* of the second floorboard when the inner element 21 is displaced and removed.

FIG. 3 shows a cross-section of the first edge 1*b* and the second edge 1*c* in a second position. The inner element 21 of the tongue 20 is in the second position displaced and removed. The outer element 22 of the tongue 20 cooperates with the tongue groove 23 at the second edge 1*c* of the second floorboard for vertical locking of the first edge 1*b* and the second edge 1*c*.

Figure 4:
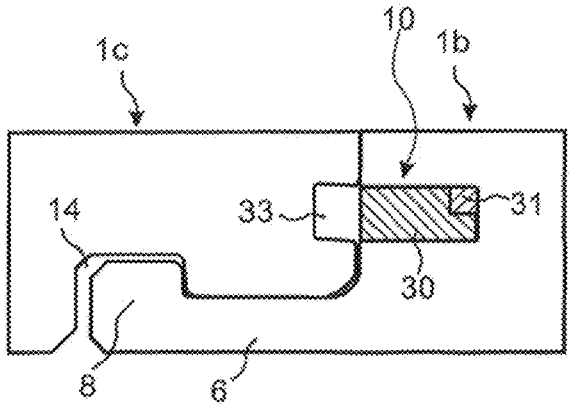
FIGS. 4-7 show a tongue comprising a guiding groove at an inner edge, according to embodiments of the present disclosure.
Figure 5:
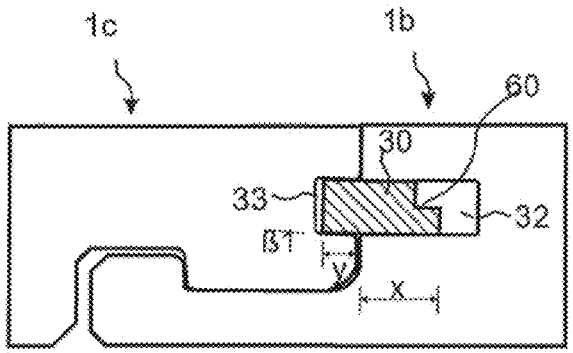

An embodiment of the present disclosure is shown in FIG. 4 and FIG. 5, with an inner and outer element 31, 30 of the tongue 10 arranged in a displacement groove 32 at a first edge 1*b* of a first floorboard. FIGS. 4 and 5 illustrate the first position and the second position, respectively, of the inner and outer elements 31, 30. The outer element 30 of the tongue 10 extends below the inner element 31 of the tongue 10, such that the inner element 31 vertically overlaps the outer element 30. The inner element 31 is in this embodiment arranged in a guiding groove 60 at an inner and upper edge of the outer element 30. The width x of a first contact surface between a lower surface of the outer element 30 of the tongue 10 and the displacement groove 32 is increased, as compared to the known locking system shown in FIG. 3, in order to improve the strength of the locking system and minimize the offset in height between the first edge 1*b* and the second edge 1*c* when a load is applied, in the second position, on the first floorboard.

The second position in which the outer element 30 is pushed into the tongue groove 33 at the second edge 1*c* is shown in FIG. 5. The outer element 30 is pushed into tongue groove 33 by a first protruding part 36 (see FIGS. 8 and 9) arranged on the inner element 31, when the inner element 31 is removed and displaced along the first edge 1*b*. A load applied on the first edge 1*b* will be taken up by a second contact surface, between an upper surface of the outer element 30 of the tongue 10 and the displacement groove 32, and a third contact surface between a lower surface of the outer element 30 of the tongue and the tongue groove 33. Since the second contact surface and the third contact surface are displaced, the load applied will result in a moment of force, which is taken up by the first contact surface. In order to increase the strength of the locking system, the width x of the first contact surface is preferably larger than the width y of the third contact surface, and preferably the width x is about twice ore more the width y. For the purpose of reducing the momentum that arises when a load is applied on the first edge 1*b*, the horizontal distance between the second and the third contact surfaces should be as small as possible, preferably less than about 1 mm and more preferably less than about 0.5 mm. This applies also to the embodiments described below.

The locking system additionally comprises in this embodiment a locking strip 6, which protrudes horizontally from the first edge 1*b*. The locking strip 6 is provided with a locking element 8 which cooperates with a locking groove 14 provided at the second edge 1*c* for horizontal locking of the first edge 1*b* and the second edge 1*c*. A load applied on the second edge 1*c* is preferably taken up by a strip contact surface between an upper surface of the locking strip 6 and a lower surface of the second edge 1*c*.

In order to push the first edge 1*b* and the second edge 1*c* vertically against each other, a lower surface of the tongue groove 33 at the third contact surface is preferably arranged with an angle β1 in relation to the horizontal plane of the floorboards. The angle β1 may be in the range of about 5° to about 20°, and preferably about 15°.

Figure 6:
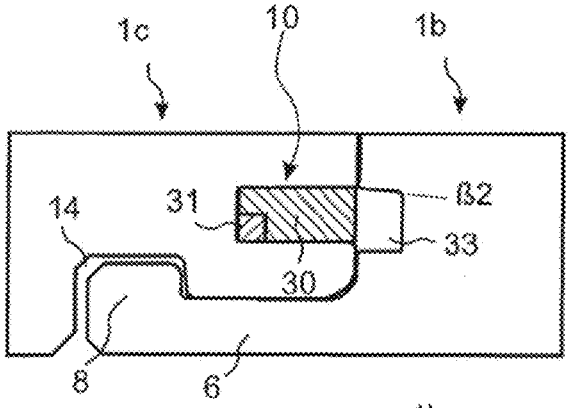
Figure 7:
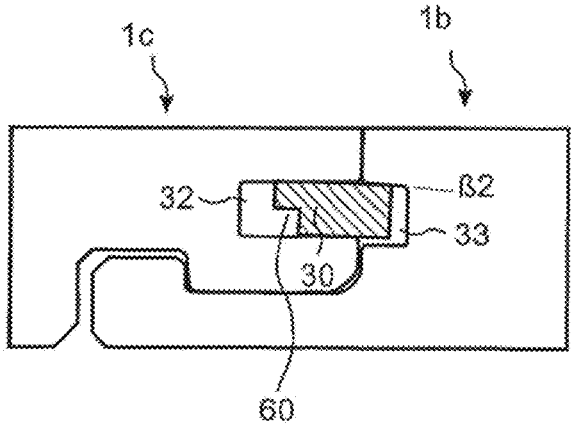

In the embodiment shown in FIGS. 6 and 7, the tongue 10 is arranged in a displacement groove 32 at the second edge 1*c*. The inner element 31 of the tongue 10 is for this embodiment preferably arranged in a guiding groove 60 at an inner and lower edge of the outer element 30 of the tongue 10 to obtain an increased first contact surface between an upper surface of the outer element 30 of the tongue 10 and the displacement groove 32. Also, in this embodiment the first contact surface takes up a momentum force resulting from a load applied at the first edge 1*b*, in a similar way as described for the embodiment shown in FIGS. 4 and 5. In order to push the first edge 1*b* and the second edge 1*c* vertically against each other, an upper surface of the tongue groove is preferably arranged with an angle β2 in relation to the horizontal plane of the floorboards. The angle β2 may be in the range of about 5° to about 20°, and preferably about 15°.

Figure 8:
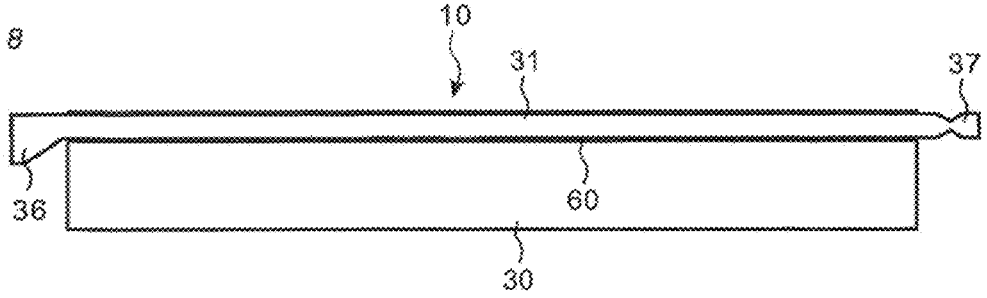
FIGS. 8 and 9 each shows a tongue from a top view, according to embodiments of the present disclosure.
Figure 9:
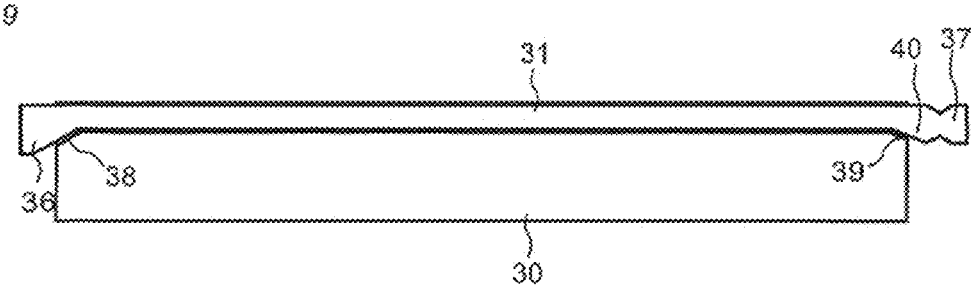

FIGS. 8 and 9 show top view embodiments of an elongated tongue 10, to be arranged in a displacement groove 32 at a first edge 1*b* of a first floorboard. The elongated tongue comprises an inner element 31, and an outer element 30. The inner element 31 is arranged in a guiding groove 60 at an inner edge of the outer element 30. The inner element 31 is preferably a bar element of an elongated shape and is provided at a first short edge with a first protruding part in the form of a wedge shaped element 36. The wedge shaped element is in a preferred embodiment guided by the guiding groove during the displacement of the inner element. The wedge shaped element 36 is configured to push the outer element 30 into a tongue groove 33 of an adjacent second edge 1*c* of a second floorboard when the inner element 31 is removed and displaced along the first edge 1*b*. The wedge shaped element 36 is, before the displacement, preferably arranged adjacent and at least partly outside a first short edge of the outer element 30 as shown in FIG. 8. A second edge of the inner element 31 is preferably provided with a gripping part 37 that facilitates the displacement of the inner element 31. FIG. 9 shows that the first short edge of the outer element 30 may be provided with first chamfer 38 that guides the wedge shaped element 36 into the guiding groove 60. The gripping part 37 is, before displacement of the inner element 31, preferably arranged adjacent a second short edge of the outer element 30 and preferably outside the second edge. As shown in FIG. 9 the inner element 31 may be provided with a second protruding part 40, for a correct positioning of the inner element 31, that before displacement of the inner element is preferably arranged in a notch or in a second chamfer 39 provided at the second short edge of the outer element 30. The outer element 30 may have a uniform cross-section from the first short edge to the second short edge. A uniform cross-section makes it possible to produce the outer element 30 at low cost, by e.g., extrusion of plastic. Also the inner element 31 may have uniform cross-section with the exception of the protruding part (wedge shaped element) 36 at the first edge. For the purpose of obtaining a correct position of the inner element 31, a preferred embodiment of the present disclosure comprises the first chamfer 38 and the second chamfer 39, which cooperate with the first protruding part 36 and the second protruding part 40, respectively.

Figure 10:
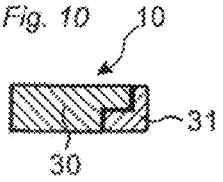
FIGS. 10 and 11 show cross-sections of a tongue comprising an L-shaped inner element, according to embodiments of the present disclosure.
Figure 11:
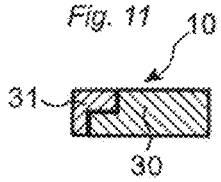
Figure 12:
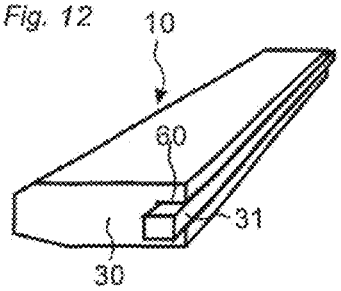
FIGS. 12-15 show tongues comprising a guiding groove at an inner surface, according to embodiments of the present disclosure.

FIGS. 10 and 11 show an embodiment of the tongue 10 comprising an L-shaped inner element 31 arranged in a corresponding guiding groove at an inner edge of the outer element 30.

Figure 13:
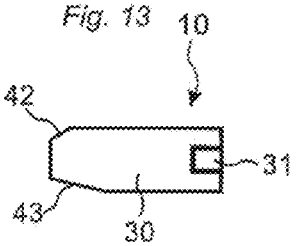
Figure 14:
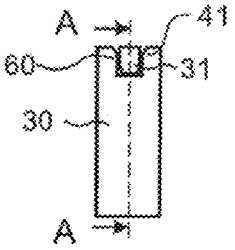
Figure 15:
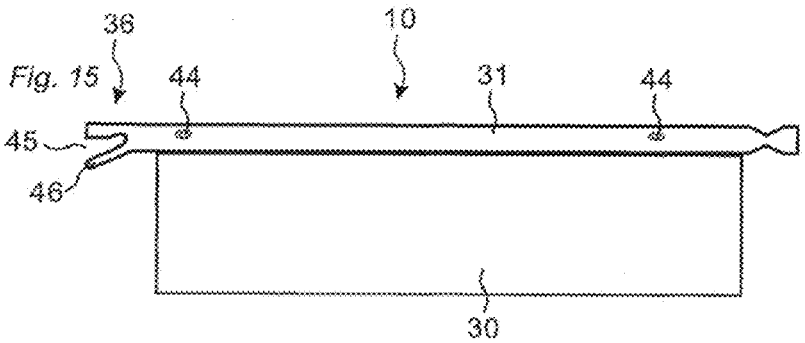

FIGS. 12-15 show an embodiment of the tongue 10 comprising inner element 31 arranged in a guiding groove 60 at an inner surface of the outer element 30. FIG. 13 shows that outer edges 42, 43 of the outer element 30 may be chamfered in order to guide the outer element 30 into the tongue groove 33. FIG. 14 shows a cross section of the tongue 10 and that the guiding groove 60 may be provided with chamfered edges 41. FIG. 15 shows a cross section of the tongue 10 in a plane indicated by AA in FIG. 14. The inner element 31 in this embodiment is provided with friction elements 44 that avert that the inner element 31 from falling out before the floorboards are installed. The first protruding part 36 is provided with a recess 45 that makes its most protruding part 46 more resilient. The most protruding part 46 may be, during the displacement of the inner element 31, compressed during, e.g., entrance of the inner element 21 into the guiding groove 60, or at any irregularities in the displacement groove 32. Also the other embodiments of the tongue 10 may be provided with a friction element 44 on the inner element 31 and/or on the outer element 30, and/or a recess 45 in the first protruding part 36.

Figure 16:
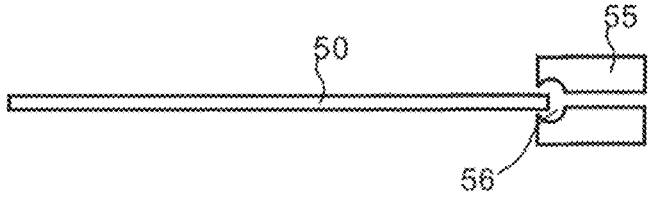
FIGS. 16-18 show a method for producing an inner element of a tongue, according to embodiments of the present disclosure.
Figure 17:
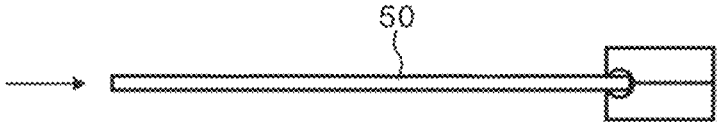
Figure 18:
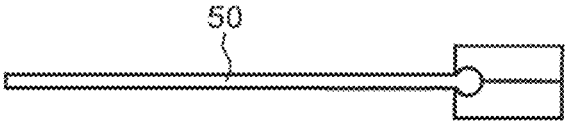
Figure 19:
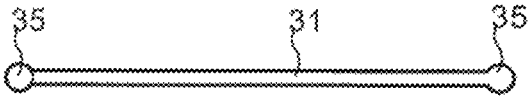
FIG. 19 shows an embodiment of an inner element of a tongue, according to an embodiment of the present disclosure.

A method for producing the first protruding part 36 and/or the second protruding part 40 of the inner element 31 is illustrated in FIGS. 16-18. A plastic blank 50 of an elongated shape is displaced into a press tool comprising a first part 55 and a second part 56. The first part 55 and the second part 56 are displaced against each other and a protruding part 35 at a first short edge of the plastic blank 50 is formed under heat and pressure. The process may be repeated for a second short edge of the plastic blank 50. The method may also comprise the step of forming the second protruding part 35 simultaneously and essentially in the same manner as the first protruding part 35. The produced first and/or second protruding part 35 may be of, for example, an essentially spherical shape or wedge shaped. FIG. 19 shows an inner element 31 that may be produced according to the method illustrated in FIGS. 16-18. The inner element 31 preferably has an essentially circular cross-section and preferably comprises protruding parts 35 of an essentially spherical shape.

Figure 20:
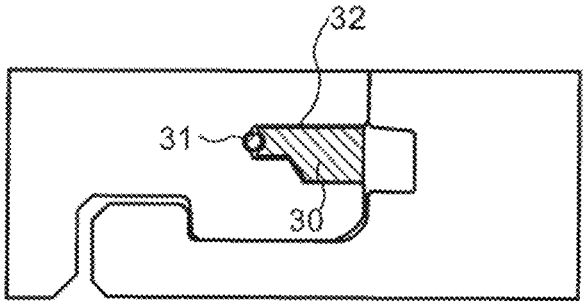
FIGS. 20 and 21 show a tongue with an inner element having a circular cross-section, according to an embodiment of the present disclosure.
Figure 21:
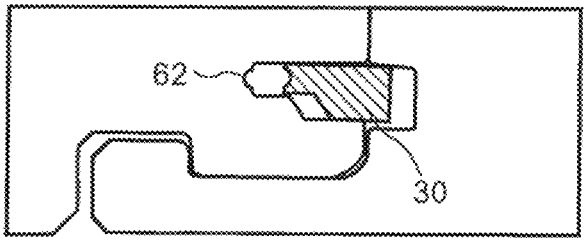

FIGS. 20 and 21 show that an inner element 31 with a circular cross section may be combined with a displacement groove 32 having an inner surface 62, which is smaller than the opening of the displacement groove 32. The inner surface 62 may be provided with a round shaped bottom that facilitates the displacement of the inner element 31.

Figure 22:
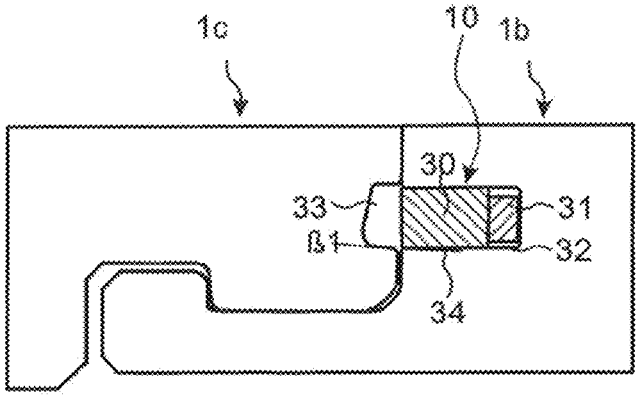
FIGS. 22-24 show a displacement groove provided with recess, according to an embodiment of the present disclosure.
Figure 23:
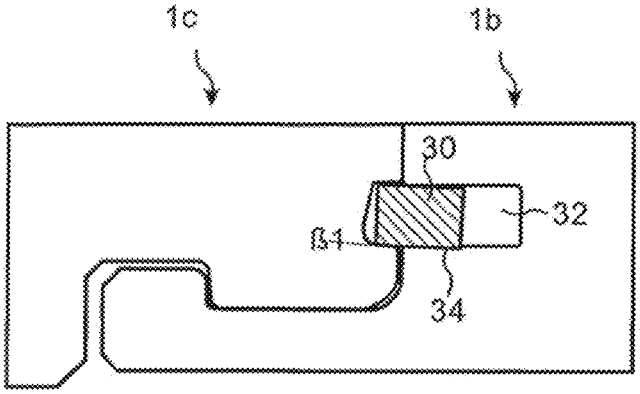
Figure 24:
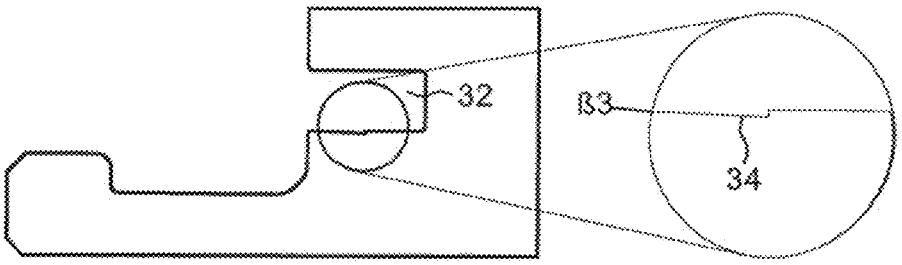

An upper or lower surface of the displacement groove 32 may be provided with a recess 34 having an angled surface at an angle β3 to the horizontal plane. The angle β3 may be in the range of about 3° to about 10°. An embodiment of the recess 34 is shown in FIGS. 22-24. The recess 34 and the angled surface has the effect that the outer element 30 of the tongue 10 tilts and the outer element 30 is restrained from being displaced back into the displacement groove 32 after the outer element 30 is pushed into the tongue groove 33 by the inner element 31. Such a recess 34 may be provided in locking systems comprising any type of the disclosed displaceable tongue.

Figure 25:
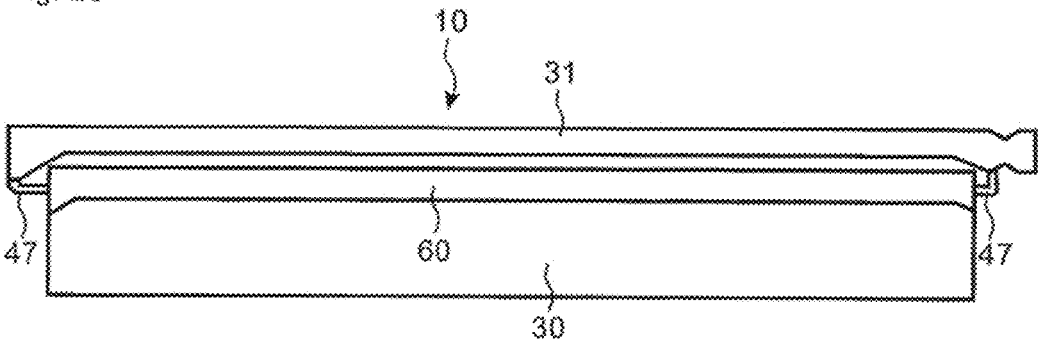
FIG. 25 shows a tongue from a top view, according to an embodiment of the present disclosure.

A preferred embodiment of the tongue 10 is shown in FIG. 25. The inner element 31 and the outer element 30 are produced in one piece by injection moulding of plastic. The inner element 31 and the outer element 30 are connected together by a connection 47 configured to break when the inner element is displaced or when the tongue is inserted into the displacement groove.

The invention claimed is:

1. Panels including at least a first floorboard and a second floorboard provided with a mechanical locking system comprising:

a displacement groove at a first edge of the first floorboard and a tongue groove at a second edge of the second floorboard; and a tongue arranged in the displacement groove and configured to cooperate, in a second position, with the tongue groove for vertical locking of the first edge and the second edge, wherein the tongue comprises, in a first position, an inner element and an outer element, the inner element being removable along the displacement groove and configured to cooperate with the outer element to obtain a displacement of the outer element towards the tongue groove and thereby obtain the second position, wherein said displacement groove includes a first inner surface, a second inner surface and a third inner surface, the second inner surface being located between and adjacent to the first and third inner surfaces, and the first, second and third inner surfaces all being angled relative to one another; and wherein the displacement groove comprises a recess formed by the first and second inner surfaces and not including the third inner surface, the recess being configured such that the outer element, overlapping the first inner surface, is restrained by the second inner surface from being displaced back further into the displacement groove to overlap the third inner surface after the outer element is pushed into the tongue groove by the inner element.

2. Panels including at least a first floorboard and a second floorboard provided with a mechanical locking system comprising:

a displacement groove at a first edge of the first floorboard and a tongue groove at a second edge of the second floorboard; and a tongue arranged in the displacement groove and configured to cooperate, in a second position, with the tongue groove for vertical locking of the first edge and the second edge, wherein the tongue comprises, in a first position, an inner element and an outer element, the inner element being removable along the displacement groove and configured to cooperate with the outer element to obtain a displacement of the outer element towards the tongue groove and thereby obtain the second position, wherein said displacement groove comprises a recess configured such that the outer element is restrained from being displaced back into the displacement groove after the outer element is pushed into the tongue groove by the inner element, wherein said inner element and said outer element vertically overlap each other in the first position.

3. Panels as claimed in claim 1, wherein the inner element, in the first position, is arranged above or below the outer element.

4. Panels as claimed in claim 1, wherein the inner element, in the first position, is arranged partly above and partly behind the outer element, or is arranged partly below the outer element and partly behind the outer element.

5. Panels as claimed in claim 1, wherein the outer element is provided with a guiding groove at either an inner and upper edge of the outer element or at an inner and lower edge of the outer element, and at least a part of the inner element in the first position is arranged in said guiding groove.

6. Panels as claimed in claim 1, wherein the outer element is provided with a guiding groove at an inner surface of the outer element, between an upper surface and a lower surface of the outer element, and at least a part of the inner element is arranged in said guiding groove in the first position.

7. Panels as claimed in claim 5, wherein the guiding groove extends essentially along the whole longitudinal length of the outer element.

8. Panels as claimed in claim 5, wherein the inner element comprises a first protruding part configured to cooperate with the guiding groove, to obtain said displacement of the outer element.

9. Panels as claimed in claim 8, wherein the first protruding part in the first position is arranged outside of the outer element.

10. Panels as claimed in claim 8, wherein the first protruding part is one of wedge shaped and essentially spherical shaped.

11. Panels as claimed in claim 1, wherein a cross section of the inner element is one of an L-shape, rectangular shape, and an essentially circular shape.

12. Panels as claimed in claim 1, wherein the entire outer element is arranged within the displacement groove in the first position.

13. Panels as claimed in claim 1, wherein the panels comprise a wood-based core made of at least one of MDF, HDF, OSB, WPC (Wood Powder Composite), and particleboard.

14. Panels as claimed in claim 1, wherein the panels comprise a plastic core.

15. Panels as claimed in claim 1, wherein the first second and third inner surfaces of the displacement groove are at an upper or lower surface of the displacement groove.

16. Panels as claimed in claim 1, wherein the first inner surface of the displacement groove is oriented at an angle $\beta 3$ to the horizontal plane.

17. Panels as claimed in claim 16, wherein the angle $\beta 3$ is in the range of about 3° to about 10°.

18. Panels as claimed in claim 8, wherein the first protruding part in the first position is arranged at least partly in a recess of the outer element.

19. Panels as claimed in claim 18, wherein the first protruding part is one of wedge shaped and essentially spherical shaped.

20. Panels as claimed in claim 1, wherein the outer element includes two opposed long edges, and a first short edge and second short edge which oppose each other, and the outer element has a uniform cross-section from the first short edge to the second short edge.

21. Panels as claimed in claim 1, wherein two corners of the substantially rectangular shape which face the inner element each has a chamfer.

22. Panels as claimed in claim 1, wherein the inner element includes two opposed long edges, a first short edge and second short edge which oppose each other, and a protruding part at the first short edge, wherein the inner element has a uniform cross-section with the exception of the protruding part at the first short edge.

23. Panels as claimed in claim 1, wherein said inner element and said outer element vertically overlap each other in the first position.

24. Panels as claimed in claim 1, wherein the outer element has a substantially rectangular shape in plan view as seen from above the first floorboard.

25. Panels as claimed in claim 1, wherein the first inner surface and the third inner surface form an angle within a range of 3° to 10°.

26. Panels as claimed in claim 1, wherein the first inner surface defines a positive angle relative to the third inner surface, and the second inner surface defines a negative angle relative to the third inner surface.

* * * * *